US005776002A

United States Patent [19]

Weber

[11] Patent Number: 5,776,002

[45] Date of Patent: Jul. 7, 1998

[54] SOLO SEESAW DEVICE

[76] Inventor: James F. Weber, 115 Terrace Ave., Camden, N.J. 08105

[21] Appl. No.: 804,073

[22] Filed: Feb. 21, 1997

[51] Int. Cl.[6] ..... A63G 11/00

[52] U.S. Cl. ..... 472/110; 472/112

[58] Field of Search ..... 472/106, 110, 472/112, 111, 108, 4

[56] References Cited

U.S. PATENT DOCUMENTS 1,317,231 9/1919 Smith ..... 472/112

3,595,569 7/1971 Holte ..... 472/4

3,614,096 10/1971 Ely ..... 472/4

*Primary Examiner*—Kien T. Nguyen

[57] ABSTRACT

A new Solo Seesaw Device for allowing a single child the fun of riding a seesaw. The inventive device includes the inventive device includes a seesaw body adapted to be supported at a point between a seat lever arm and a counterweight lever arm both included on the seesaw body. A counterweight assembly is included on the counterweight lever arm providing counterweight to an individual using the Solo Seesaw Device. The Solo Seesaw Device is pivotably and rotatably mounted to a base providing an upstanding vertical support by means of a pivot arrangement.

6 Claims, 3 Drawing Sheets

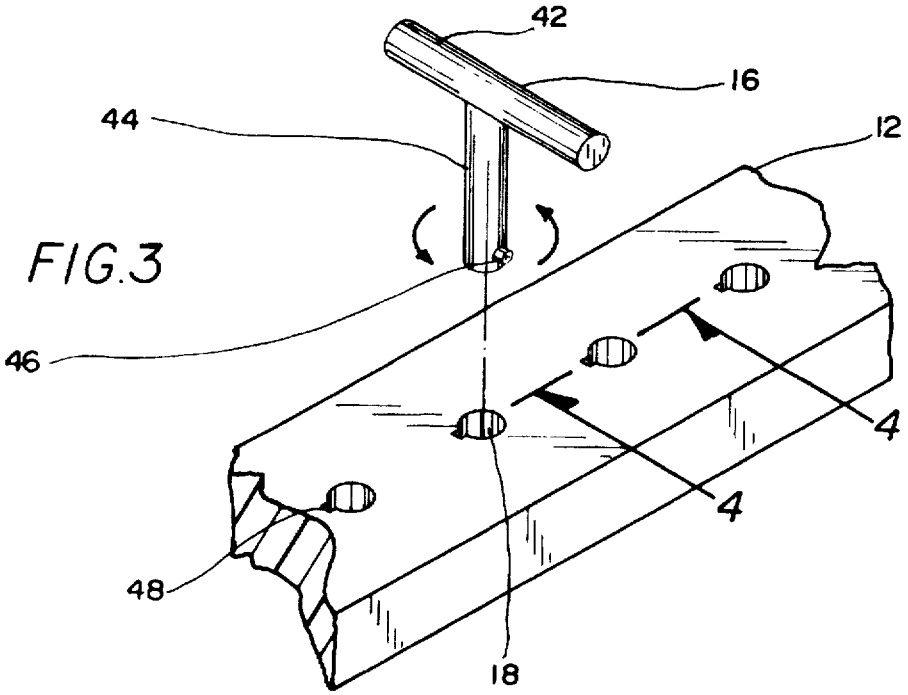
FIG.3
FIG.4
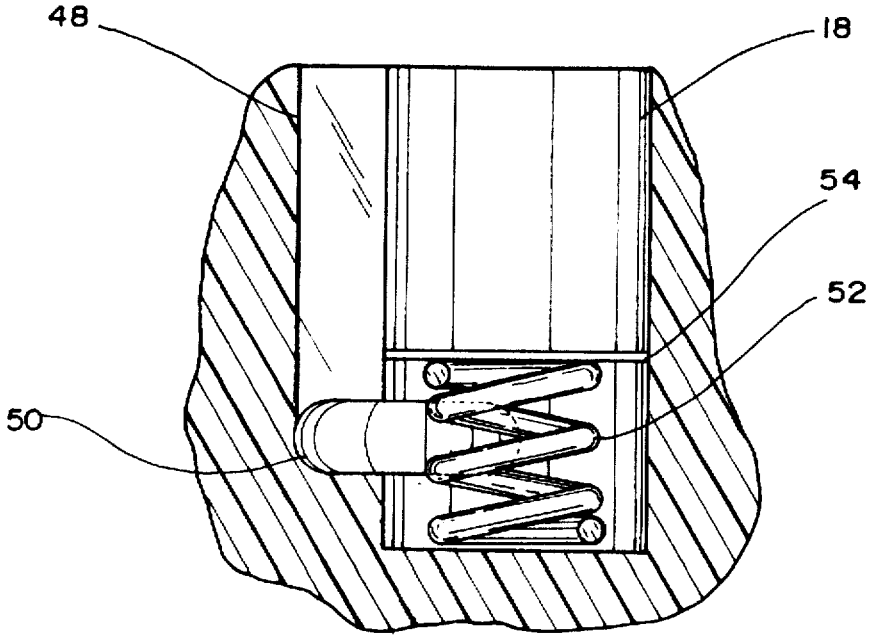

SOLO SEESAW DEVICE

BACKGROUND OF THE INVENTION

1. Field of the Invention

The present invention relates to seesaw devices and more particularly pertains to a new Solo Seesaw Device for allowing a single child the fun of riding a seesaw.

2. Description of the Prior Art

The use of seesaw devices is known in the prior art. More specifically, seesaw devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art seesaw devices include U.S. Pat. No. 4,032,138; U.S. Pat. No. 4,319,746; U.S. Pat. Des. 269,538; U.S. Pat. No. 4444; U.S. Pat. No. 3,968,962 and U.S. Pat. No. 4,226,411.

While these devices fulfill their respective, particular objectives and requirements, the aforementioned patents do not disclose a new Solo Seesaw Device. The inventive device includes a seesaw body adapted to be supported at a point between a seat lever arm and a counterweight lever arm both included on the seesaw body. A counterweight assembly is included on the counterweight lever arm providing counterweight to an individual using the Solo Seesaw Device. The seesaw body is pivotably and rotatably mounted to a base providing an upstanding vertical support by means of a pivot arrangement.

In these respects, the Solo Seesaw Device according to the present invention substantially departs from the conventional concepts and designs of the prior art, and in so doing provides an apparatus primarily developed for the purpose of allowing a single child the fun of riding a seesaw.

SUMMARY OF THE INVENTION

In view of the foregoing disadvantages inherent in the known types of seesaw devices now present in the prior art, the present invention provides a new Solo Seesaw Device construction wherein the same can be utilized for allowing a single child the fun of riding a seesaw.

The general purpose of the present invention, which will be described subsequently in greater detail, is to provide a new Solo Seesaw Device apparatus and method which has many of the advantages of the seesaw devices mentioned heretofore and many novel features that result in a new Solo Seesaw Device which is not anticipated, rendered obvious, suggested, or even implied by any of the prior art seesaw devices, either alone or in any combination thereof.

To attain this, the present invention generally comprises a seesaw body adapted to be supported at a point between a seat lever arm and a counterweight lever arm both included on the seesaw body. A counterweight assembly is included on the counterweight lever arm providing counterweight to an individual using the Solo Seesaw Device. The seesaw body is pivotably and rotatably mounted to a base providing an upstanding vertical support by means of a pivot arrangement.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Solo Seesaw Device apparatus and method which has many of the advantages of the seesaw devices mentioned heretofore and many novel features that result in a new Solo Seesaw Device which is not anticipated, rendered obvious, suggested, or even implied by any of the prior art seesaw devices, either alone or in any combination thereof.

It is another object of the present invention to provide a new Solo Seesaw Device which may be easily and efficiently manufactured and marketed.

It is a further object of the present invention to provide a new Solo Seesaw Device which is of a durable and reliable construction.

An even further object of the present invention is to provide a new Solo Seesaw Device which is susceptible of a low cost of manufacture with regard to both materials and labor, and which accordingly is then susceptible of low prices of sale to the consuming public, thereby making such Solo Seesaw Device economically available to the buying public.

Still yet another object of the present invention is to provide a new Solo Seesaw Device which provides in the apparatuses and methods of the prior art some of the advantages thereof, while simultaneously overcoming some of the disadvantages normally associated therewith.

Still another object of the present invention is to provide a new Solo Seesaw Device for allowing a single child the fun of riding a seesaw.

Yet another object of the present invention is to provide a new Solo Seesaw Device which includes the inventive device includes a seesaw body adapted to be supported at a point between a seat lever arm and a counterweight lever arm both included on the seesaw body. A counterweight assembly is included on the counterweight lever arm providing counterweight to an individual using the Solo Seesaw Device. The seesaw body is pivotably and rotatably mounted to a base providing an upstanding vertical support by means of a pivot arrangement.

Still yet another object of the present invention is to provide a new Solo Seesaw Device that it can provide vertical motion and rotational motion in a full circle to provide an interesting ride to the user.

Even still another object of the present invention is to provide a new Solo Seesaw Device that the seesaw body may be shaped into many figures such as a bird or a rocket ship and that the user can sit on the seat lever arm either facing the counterweight lever arm or facing away from it allowing riders to use their imagination while riding the Solo Seesaw Device.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an exploded isometric illustration of the present invention.

FIG. 4 is a partial cross-sectional view taken along line 4—4 of FIG. 3.

DESCRIPTION OF THE PREFERRED EMBODIMENT

Figure 1:
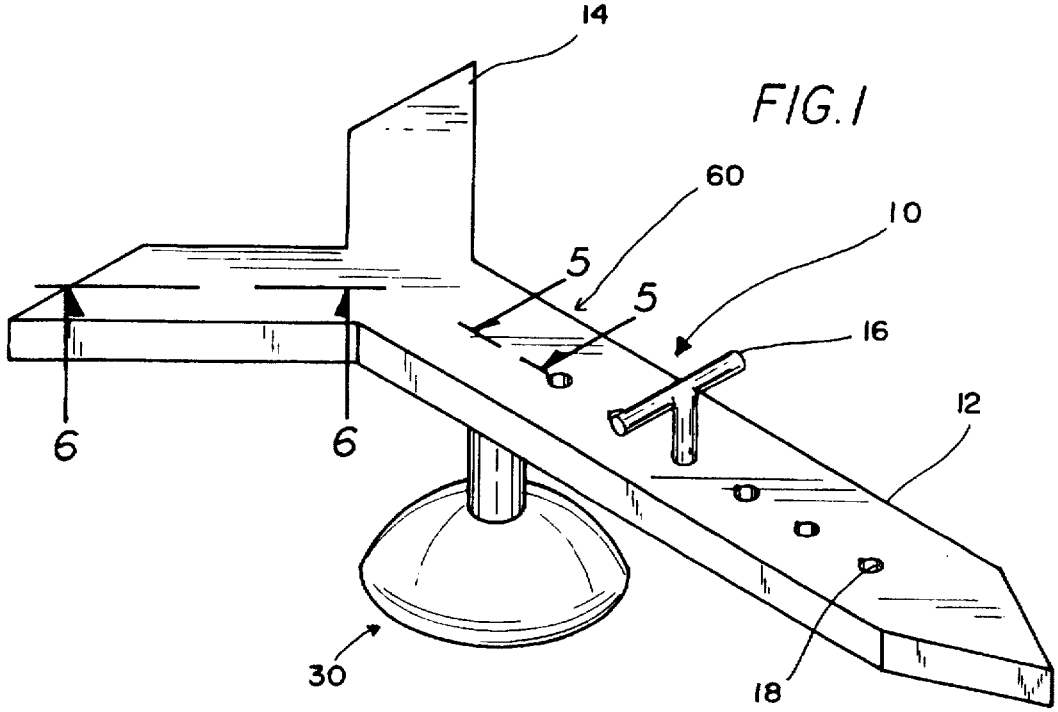
FIG. 1 is a perspective view of a Solo Seesaw Device according to the present invention.

With reference now to the drawings, and in particular to FIGS. 1 through 6 thereof, a new Solo Seesaw Device embodying the principles and concepts of the present invention and generally designated by the reference numeral 10 (FIGS. 1 & 2) will be described.

Figure 2:
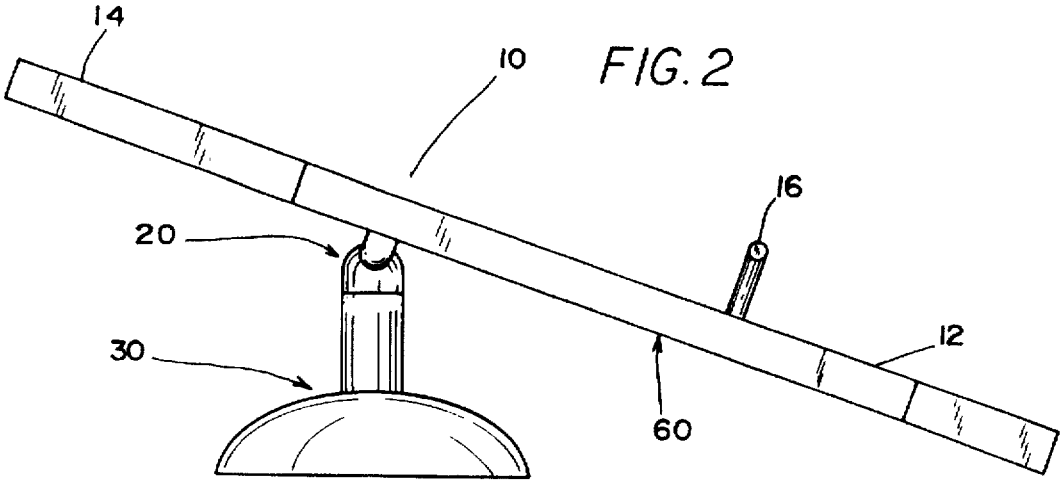
FIG. 2 is a side elevation view thereof.
Figure 5:
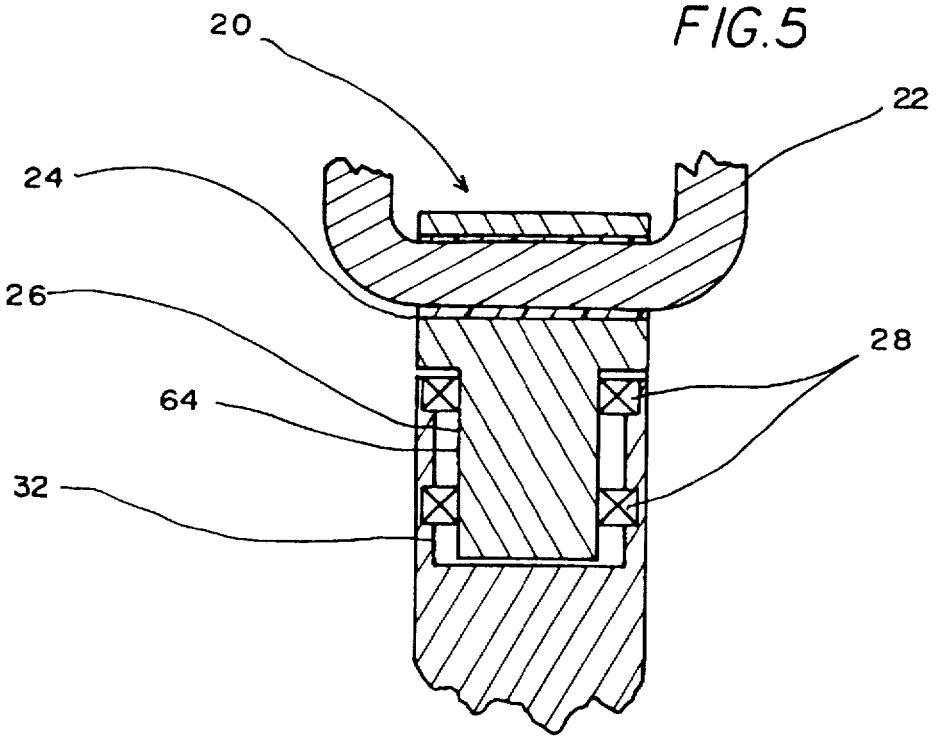
FIG. 5 is a cross sectional view taken along line 5—5 of FIG. 1.
Figure 6:
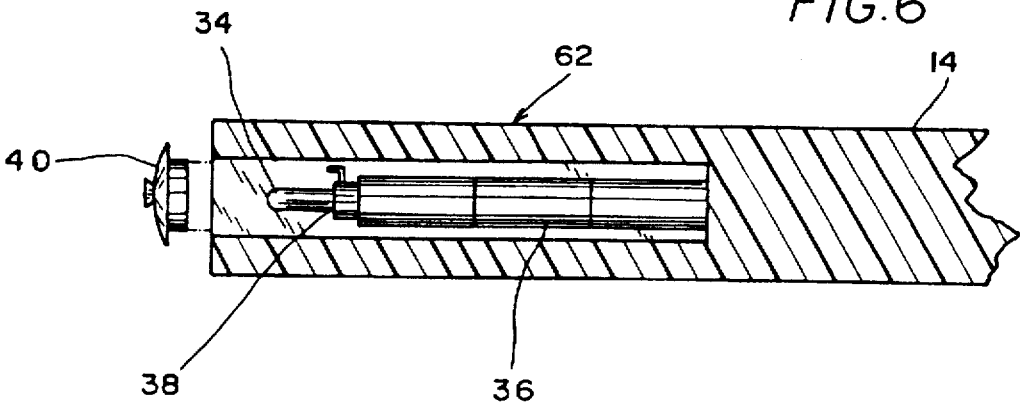
FIG. 6 is a cross sectional view taken along line 6—6 of FIG. 1.

More specifically, it will be noted that the Solo Seesaw Device 10 comprises a seesaw body 60 (FIGS. 1 & 2) including a seat lever arm 12 (FIGS. 1, 2 & 3) and a counterweight lever arm 14 (FIGS. 1, 2 & 6). A counterweight assembly 62 (FIG. 6) is included on the counterweight lever arm 14. The seesaw body 60 is pivotably and rotatably mounted to a base 30 (FIGS. 1 & 2) providing an upstanding vertical support by means of a pivot arrangement 20 (FIGS. 2 & 5).

As best illustrated in FIGS. 1 through 6, it can be shown that the Solo Seesaw Device 10 comprises a seesaw body 60 which includes a seat lever arm 12 and at least one counterweight arm 14. The seesaw body 60 is adapted to be supported at a point between a seat lever arm 12 and counterweight lever arm 14. The seesaw body 60 is pivotly and rotatably mounted by means of pivot arrangement 20 to a base 30 providing a means of upstanding vertical support. The counterweight lever arm 14 houses a counterweight assembly 62 to provide a counterweight to rider of the Solo Seesaw Device 10.

A handle 16 (FIGS. 1, 2 & 3) having handgrips 42 (FIG. 3) included on the seat lever arm 12 allows the user a means to hold on to the Solo Seesaw Device 10 while sitting on the seat lever arm 12. The handle 16 also includes a handle post 44 (FIG. 3) having a retaining peg 46 (FIGS. 3 & 4) allowing the handle 16 to be removably attached to the seat lever arm 12 by means of a handle slot 18 (FIGS. 1, 3 & 4) which includes a retaining peg slot 48 (FIGS. 3 & 4), a retaining peg locking slot 50 (FIG. 4) and a spring 52 (FIG. 4) with a spring cover 54 (FIG. 4) disposed inside the handle slot 18. The handle 16 is secured to the seat lever arm 12 by inserting the handle post 44 into the handle slot 18 and turning the handle to position the retaining peg 46 in the retaining peg locking slot 50. The seat lever arm 12 may have a plurality of spaced apart handle slots 18 to allow positioning of the handle 16 along the seat lever arm to ideally balance the weights of different users with the counterweight assembly 62 weights 36 (FIG. 6).

The counterweight assembly 62 consists of a weight bar 34 (FIG. 6) coupled to the counterweight lever arm 14 with weights 36 disposed on the weight bar 34 and secured by means of a clamp 38 (FIG. 6) on the weight bar 34. Various numbers and different weighing weights 36 may be used in the counterweight assembly 62 to achieve the appropriate counterweight for the user of the Solo Seesaw Device 10. The weight bar 34 may also be telescopic to extend its length to accept more weights 36. The entire counterweight assembly may also be hidden from view by means of an end cap 40 (FIG. 6) covering the exposed counterweight assembly.

The pivot arrangement 20 basically comprises a pivot and shaft socket type joint that allows the seesaw body 60 to pivot in an up and down motion typical of seesaw devices and also rotate 360° in a horizontal plane around the base 30. The pivot arrangement 20 comprises a pivot member 26 (FIG. 5) having pivot hole 24 (FIG. 5) and a pivot shaft end 64 (FIG. 5) and a shaft socket 32 (FIG. 5) which is included on the base 30. The shaft socket 32 accepts the pivot shaft end 64 of the pivot member 26. A plurality of ball bearings 28 (FIG. 5) are interposed between the shaft socket 32 and the pivot shaft end 64 to facilitate the rotational motion of the pivot arrangement 20. A U-shaped pivot bolt 22 (FIG. 5) is disposed through the pivot hole 24 (FIG. 5) and is securely attached to the seesaw body 60 at a point between the seat lever arm 12 and the counterweight lever arms 14. As an optional alternative to the pivot and shaft socket type joint, the pivot arrangement 20 may be comprised of a ball and socket type joint instead.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A solo seesaw device comprising:

a base providing upstanding vertical support means;

a seesaw body;

a seat lever arm included on said seesaw body;

a counterweight lever arm included on said seesaw body;

said seesaw body being supported on said base at a point between said seat lever arm and said counterweight lever arm;

a pivot arrangement pivotly coupled to said seesaw body and rotatably mounted to said base for mounting said seesaw body on said base;

a counterweight assembly included on said counterweight lever arm providing counterweight to the weight of a user seated on the seat lever arm of said seesaw body to thereby permit a single user to produce a rocking motion of said seesaw body with respect to said base;

a handle removably attached to said seat lever arm; and wherein said seat lever arm further comprises a plurality of handle slots for said handle.

2. The solo seesaw device of claim 1, wherein said handle further comprises a handgrip and a handle post, said handle post including a retaining peg, said handle slots including a retaining peg locking slot and a spring disposed inside said handle slot, and said retaining peg locking slot accepting said retaining peg of said handle post.

3. The solo seesaw device of claim 1, further comprising a plurality of counterweight lever arms each including a counterweight assembly.

4. A solo seesaw device comprising:

a base providing upstanding vertical support means;

a seesaw body;

a seat lever arm included on said seesaw body;

a counterweight lever arm included on said seesaw body;

said seesaw body being supported on said base at a point between said seat lever arm and said counterweight lever arm;

a pivot arrangement pivotly coupled to said seesaw body and rotatably mounted to said base for mounting said seesaw body on said base;

a counterweight assembly included on said counterweight lever arm providing counterweight to the weight of a user seated on the seat lever arm of said seesaw body to thereby permit a single user to produce a rocking motion of said seesaw body with respect to said base; and wherein said counterweight assembly further comprises: a weight bar having a first end coupled to said counterweight lever arm; a clamp disposed on said weight bar; and at least one weight disposed on said weight bar between said clamp and said first end.

5. The solo seesaw device of claim 4, wherein the pivot arrangement further comprises: a ball having a pivot hole and a socket end; a socket included on said base accepting said socket end of said ball; a plurality of ball bearings interposed between said socket and said socket end of said ball; a U-shaped pivot bolt disposed through said pivot hole and coupled to said seesaw body at said point between said seat lever arm and said counterweight lever arm.

6. A solo seesaw device comprising:

a base providing upstanding vertical support means;

a seesaw body;

a seat lever arm included on said seesaw body;

a plurality of counterweight lever arm included on said seesaw body;

said seesaw body adapted to be supported at a point between said seat lever arm and said counterweight lever arm;

a pivot arrangement pivotly coupled to said seesaw body and rotatably mounted to said base for mounting said seesaw body on said base; and each of counterweight lever arms including a counterweight assembly thereon on, said counterweight lever arms providing counterweight to the weight of a user seated on the seat lever arm of said seesaw body to thereby permit a single user to produce a rocking motion of said seesaw body with respect to said base.

* * * * *